US005551125A

United States Patent [19]

Adams

[11] Patent Number: 5,551,125

[45] Date of Patent: Sep. 3, 1996

[54] QUICK RELEASE HINGED SUPPORT

[76] Inventor: Thomas J. Adams, 154 Prairiewood Dr., Fargo, N. Dak. 58103

[21] Appl. No.: 323,255

[22] Filed: Oct. 14, 1994

[51] Int. Cl.[6] ..... E05D 7/10

[52] U.S. Cl. ..... 16/229; 16/257; 16/261

[58] Field of Search ..... 16/254, 257, 258, 16/259, 260, 261, 262, 229, 380, 263, 270, 386

[56] References Cited

U.S. PATENT DOCUMENTS

| | | | |
|---|---|---|---|
| 682,071 | 9/1901 | Hartmann | 16/261 |
| 1,463,358 | 7/1923 | Cordes . | |
| 3,338,609 | 3/1966 | Banas | 16/229 |
| 3,521,225 | 6/1968 | Kursman . | |
| 3,984,003 | 10/1976 | Gilreath . | |
| 4,302,866 | 12/1981 | Irvin | 16/257 |
| 4,455,711 | 6/1984 | Anderson | 16/258 |

*Primary Examiner*—M. Rachuba
*Assistant Examiner*—Donald M. Gurley
*Attorney, Agent, or Firm*—David A. Lingbeck

[57] ABSTRACT

A quick release hinged support or bracket for coupling two cooperating objects together comprises a pair of plates each having opposed side walls and openings for mounting to the objects and further comprises retractable coupling members for hingedly coupling the two plates together. The retractable coupling members allows a user to quickly separate the plates of the hinged support and the two cooperating objects so that the user can conveniently and substantially clean the two objects such as a lid or cover attachable to a container or an appliance. The hinged support allows the user to quickly separate the two objects without having to use a tool.

7 Claims, 5 Drawing Sheets

QUICK RELEASE HINGED SUPPORT

BACKGROUND OF THE INVENTION

The present invention relates to a quick release hinged support hingedly connecting a lid, cover, door, or some other closure to an apparatus or device such as a container, small appliances such as bread making devices, or ovens, or even refrigerators.

A bracket having hingedly coupled plates is commonly used to support doors, lids, covers, or other closures on the main body to which they are attached. In all cases, the plates of the hinged bracket are attached to one another with bolts, rivets, or other fasteners which cannot be removed without a tool of some kind to remove the lid, cover, or other closure from the main body. To remove the lid or cover from the main body, the user has to use a screwdriver or wrench to unscrew the screws out of the main body or lid to remove the lid from the main body. In almost every instance, the bracket itself cannot be easily separated because the plates of the bracket are essentially riveted or fixedly fastened together.

One known prior art is a BRACKET FOR SUPPORTING OBJECTS AND ESPECIALLY FOR SECURING NUMBER PLATES, U.S. PAT. NO. 1,463,358, INVENTOR: AUGUST W. CORDES, which comprises a bolt forming the common axle for a hinged bracket. The bolt is fastened to the bracket with a nut or a capped end and can be removed only with a tool and is not similar to the present invention.

Another known prior art is an UNDERWATER TRANSDUCER AND MOUNTING BRACKET ASSEMBLY, U.S. PAT. NO. 3,521,225, INVENTOR: JEROME KURSMAN, which comprises a bracket having a first plate fastened with a bolt and nut to a second plate which is pivotable relative to the first plate, but the first plate cannot be separated from the second plate easily as can be done with the present invention.

Another known prior art is a HINGED SUPPORT, U.S. PAT. NO. 3,984,003, INVENTOR: ROBERT V. GILREATH, which comprises a first bracket attached to an oven surface and a second bracket pivotally supported by the first bracket, but rivets as such are used to connect the first bracket to the second bracket making it very difficult to quickly separate the brackets as can be done with the present invention.

None of the prior art describes or suggests a hinged support or bracket which can be easily taken apart so that one portion of the support which is fixedly attached to the lid can be removed from another portion of the support which is fixedly attached to the main body without having to use tools as such.

SUMMARY OF THE INVENTION

This invention relates to a quick release hinged support which comprises a first plate having opposed side walls perpendicular and integral to the first plate, a second plate also having opposed side walls perpendicular and integral to the second plate, and a pair of biased coupling members for releasably and hingedly coupling the first plate to the second plate, the plates being fixedly fastenable to lids and containers as such or to covers and main bodies.

One objective of the present invention is to provide a hinged support which can be quickly taken apart without tools as such to remove the hingedly attached objects from one another to which the hinged support is fixedly attached.

Another objective of the present invention is to provide a hinged support which allows the user to easily and conveniently remove a door, lid, cover, or some other type of closure from the main body without having to use tools to do so.

Yet, another objective of the present invention is to provide a hinged support which makes it easy for the user to replace or repair closures without having to replace the entire apparatus such as container and appliances.

Further objectives and advantages of the present invention will become apparent as the description proceeds and when taken in conjunction with the accompanying drawings wherein:

DETAILED DESCRIPTION OF THE INVENTION

Figure 1:
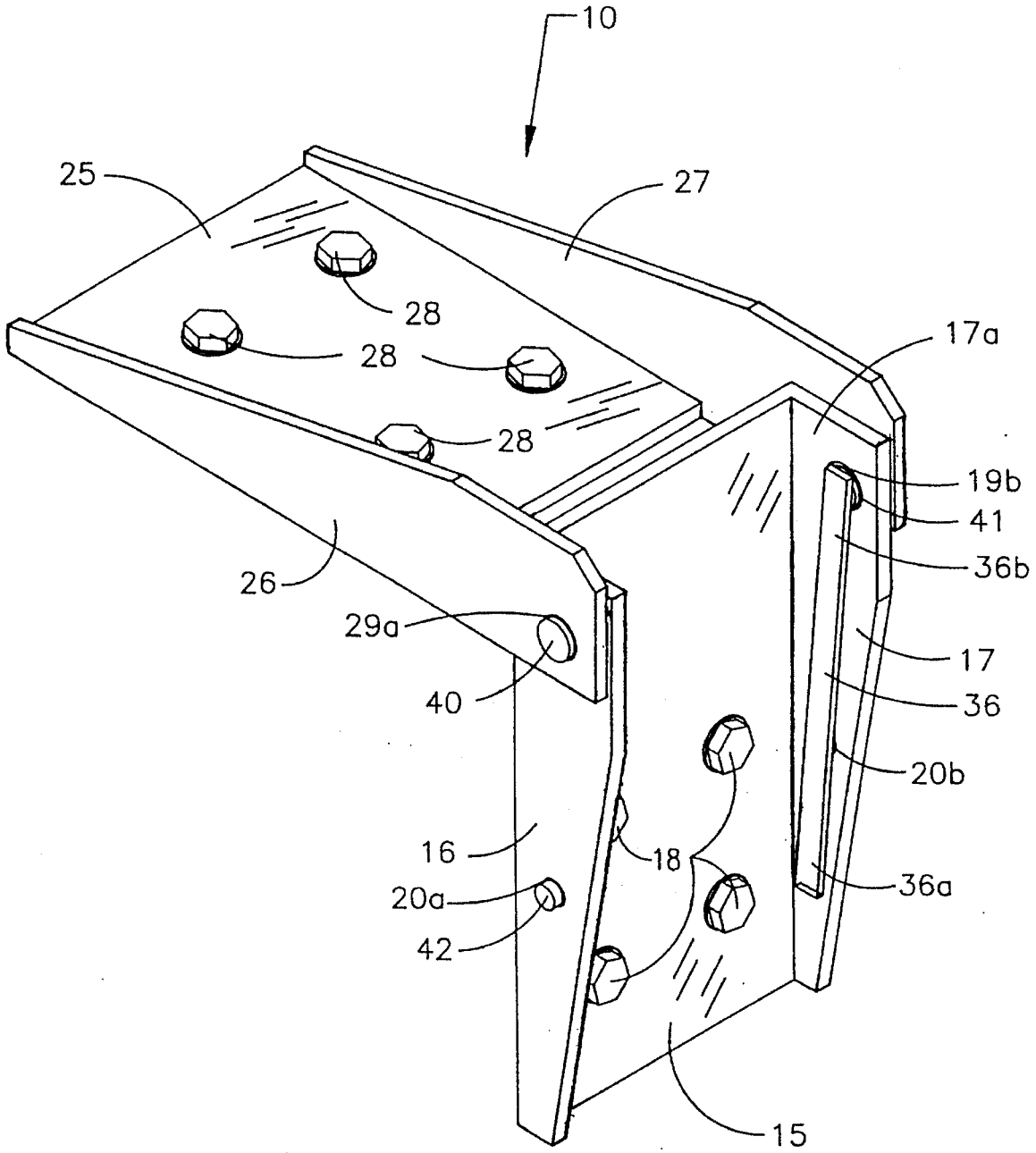
FIG. 1 is one perspective view of the quick release hinged support.
Figure 2:
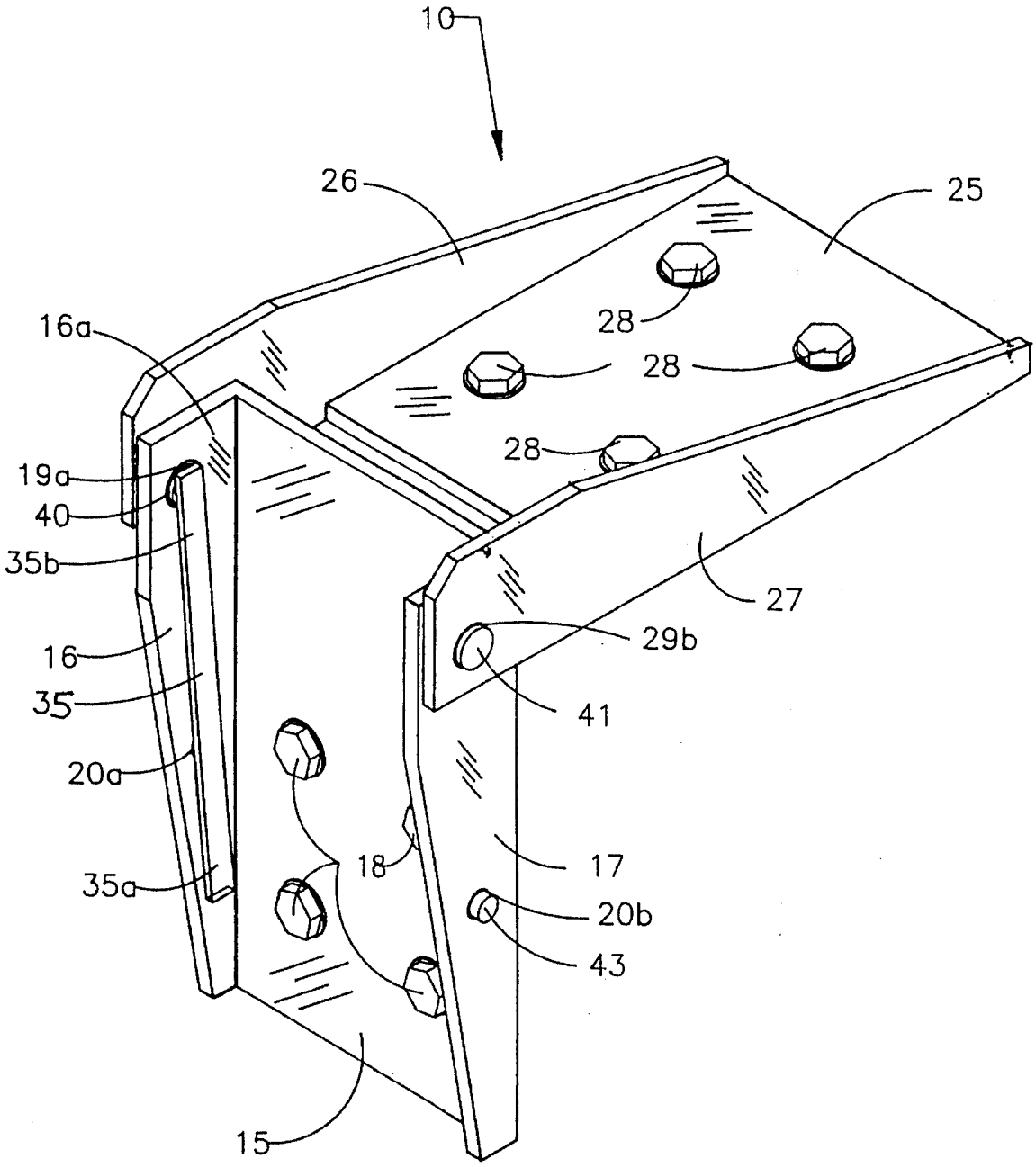
FIG. 2 is another perspective view of the quick release hinged support.
Figure 3:
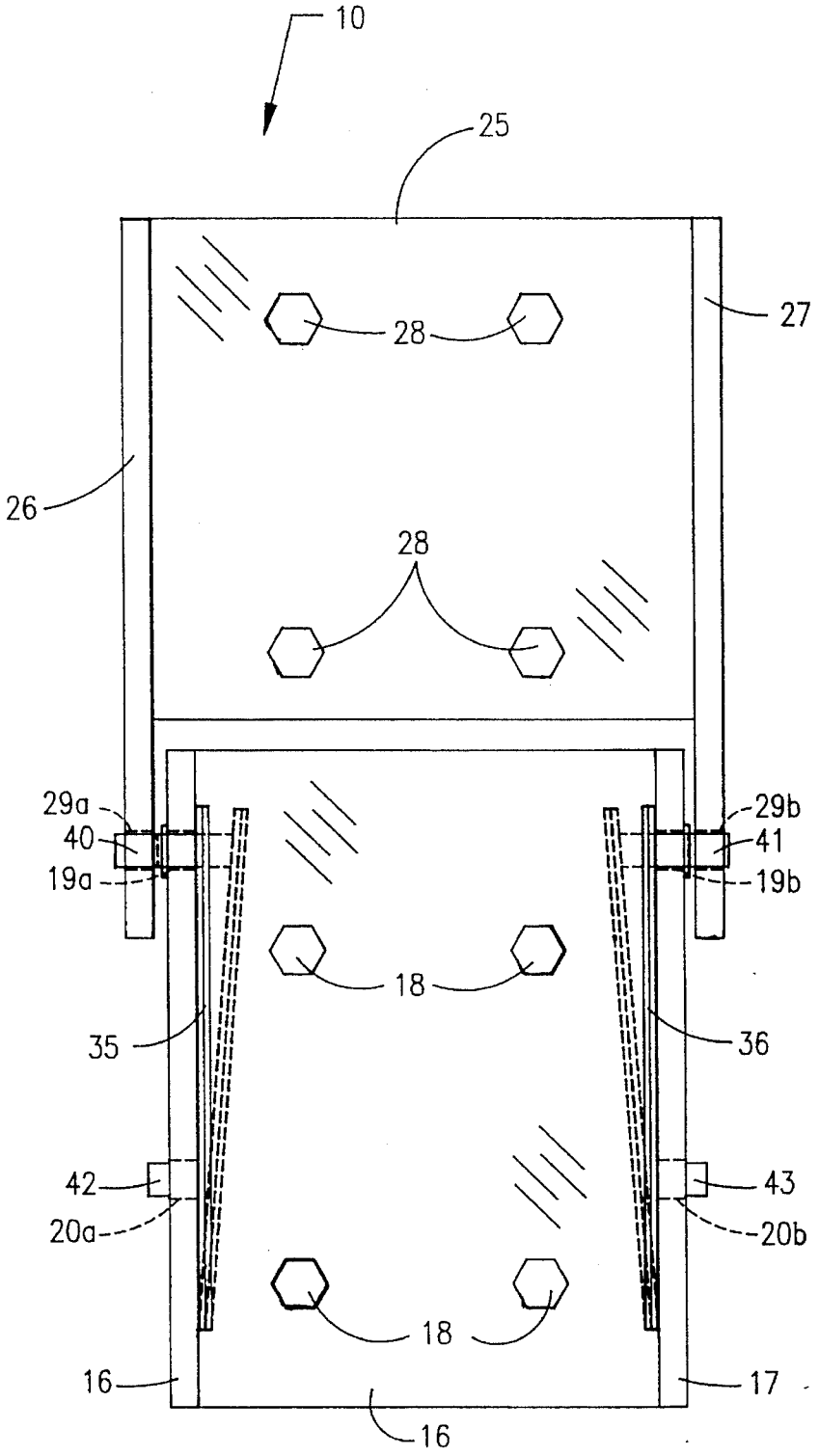
FIG. 3 is a front elevation view of the quick release hinged support showing, in particular, a hatched outline of the retracted fastener means.
Figure 4:
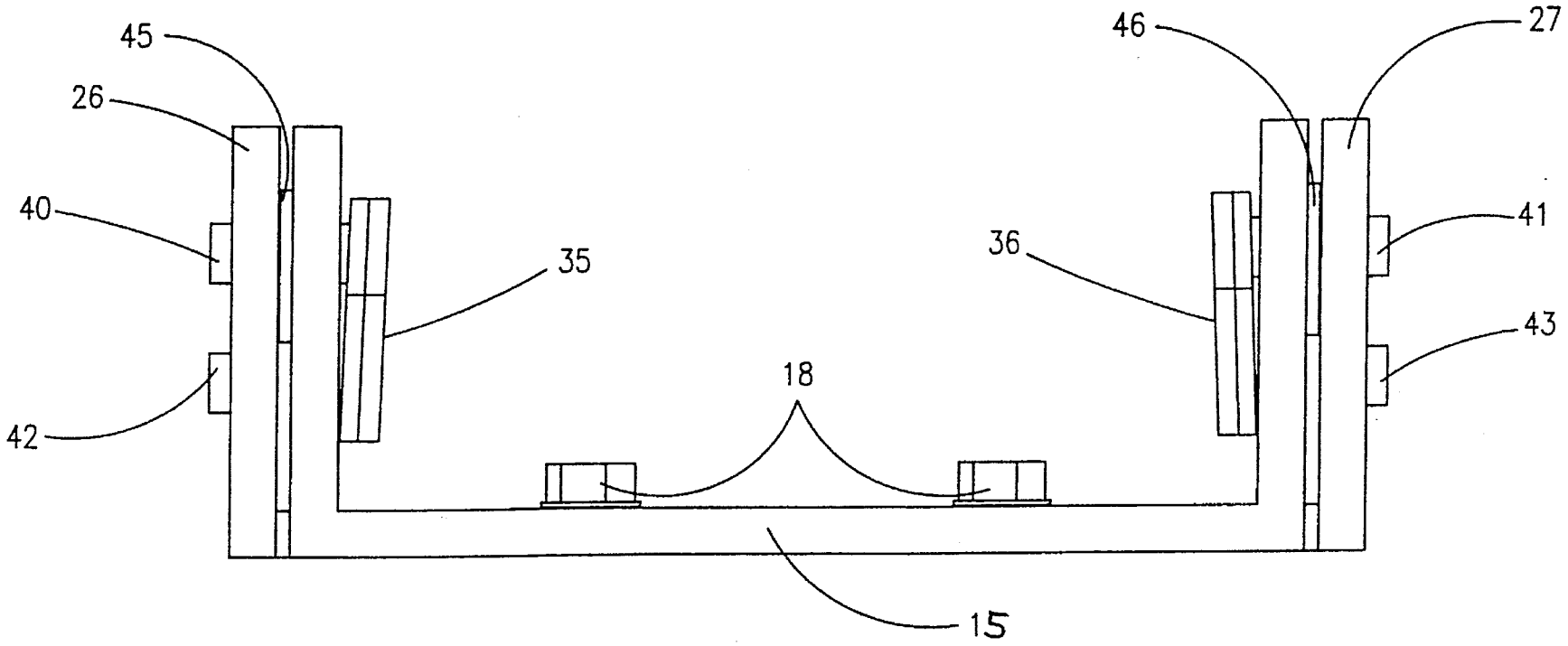
FIG. 4 is a top edge view of the quick release hinged support.
Figure 5:
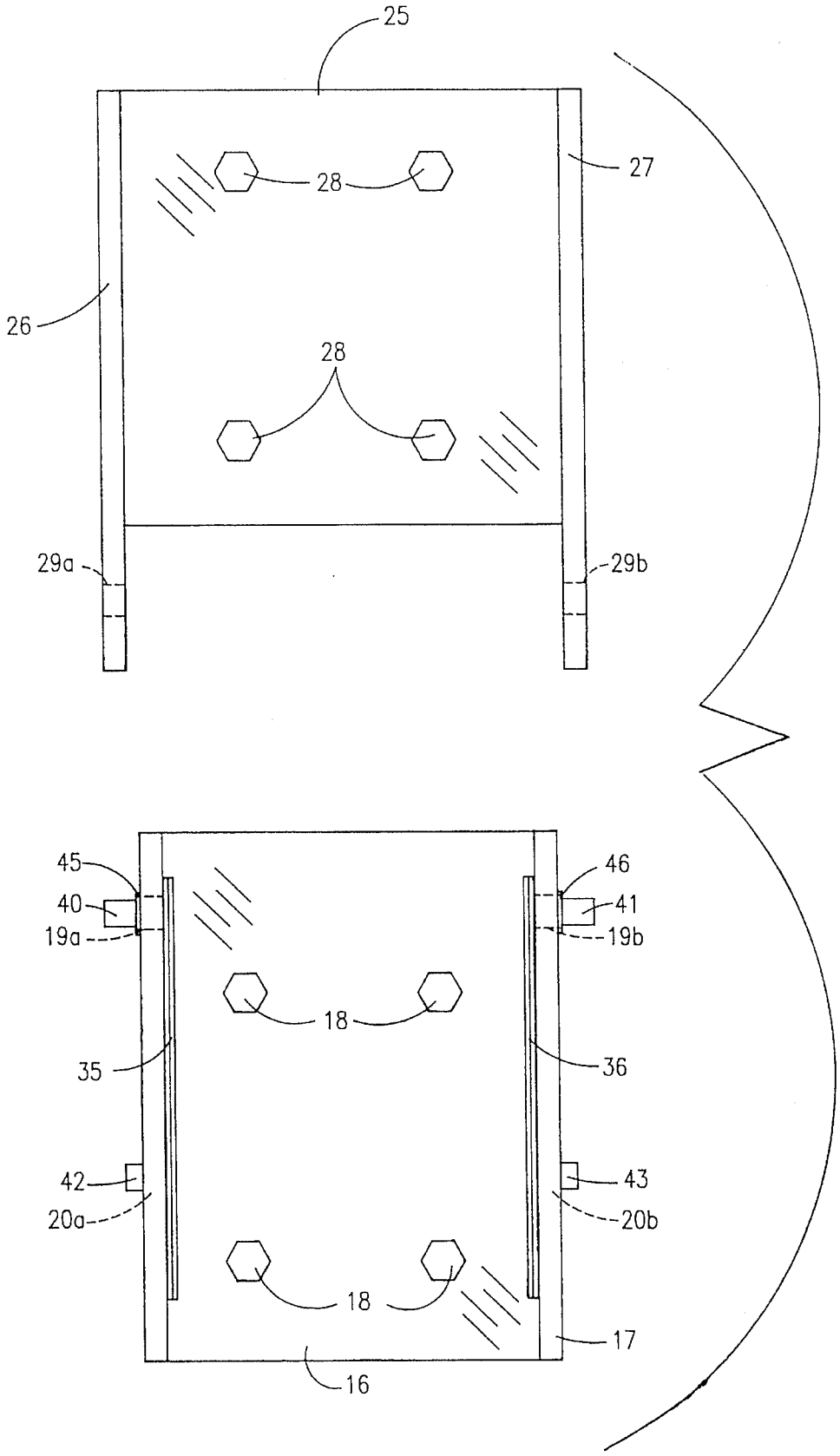
FIG. 5 is a front elevation view of the quick release hinged support with the two plates separated from one another.

Referring to the drawings in FIGS. 1–5, the quick release hinged support 10 comprises a first plate 15 having opposed side walls 16 & 17 or ears perpendicular and integral to the first plate 15, and further comprises a second plate 25 having opposed side walls 26 & 27 or ears perpendicular and integral to the second plate 25, and also comprises a retractable coupling means attached to the first plate 15 for releasably coupling the two plates 15 & 25 together to form a hinged support 10 or bracket. The second plate 25 is conventionally adapted and dimensioned to receive at least portions of the two side walls 16 & 17 of the first plate 15 in between the side walls 26 & 27 thereof so that the two plates 15 & 25 can be easily and conveniently coupled to one another and pivoted relative to one another. A plurality of openings 18 & 28 extend through both plates 15 & 25. Fasteners such as screws or bolts can be used to extend through the plurality of openings 18 & 28 to fastenably mount the plates 15 & 25 to two cooperating objects such as a lid and a container, a door and an appliance, or other closures and main bodies to which the closures are fastened. Each of the side walls 16 & 17 of the first plate 15 has a first hole **19*a* & 19*b* and a second hole 20*a* & 20*b*. The first hole 19*a* in one side wall 16 is aligned with the first hole 19*b* in the other side wall 17, and the two second holes 20*a* & 20*b* are substantially aligned to one another. Two holes 29*a* & 29*b* extend through the side walls 26 & 27 of the second plate 25, one hole 29*a* extending through one of the side walls 26 and the other hole 29*b* extending through the other side wall 27**, both which are in alignment with each other.

As illistrated in FIGS. 1–4, the retractable coupling means comprises a pair of elongate biased elements 35 & 36 or leaf springs each having an end portion **35*a* & 35*b* fixedly attached or welded to a side wall 16 & 17 of the first plate 15 and disposed generally parallel to the first plate 15, one biased element 35 being fixedly attached to one side wall 16** and the other biased element 36 being fixedly attached to the other side wall 17. Each of the elongate biased elements 35 & 36 is fixedly attached to the side 16*a* & 17*a* of the side wall facing the opposing side wall. Two coupling members 40 & 41 such as pegs are fixedly attached or welded to end portions 35*b* & 36*b* of the elongate biased elements 35 & 36, opposed to the end portions 35*a* & 36*a* fixedly attached to the side walls 16 & 17, one coupling member 40 attached to one biased element 35 and the other coupling member 41 attached to the other biased element 36, both of which are generally disposed perpendicular to the respective biased elements 35 & 36. The coupling members 40 & 41 are retractably and biasedly disposed through the first holes 19*a* & 19*b* in the side walls 16 & 17 of the first plate 15 and are extendable through the holes 29*a* & 29*b* in the side walls 26 & 27 of the second plate 25 for hingedly coupling the two plates 15 & 25 together. A guide member 45 & 46 having at least one flange portion and a bore extending therethrough for facilitating sliding of the coupling member 40 & 41 is mounted to the exterior of each side wall 16 & 17 over the first hole 19*a* & 19*b* and disposed substantially flush with the side wall 16 & 17 and with the bore being substantially in alignment with the first hole 16 & 17. The bore through each of the guide members 45 & 46 is tapered outwardly with respect to the side wall 16 & 17 for facilitating slidable movement of the coupling member 40 & 41 so that the coupling member 40 & 41 will not bind in the bore or in the first hole 19*a* & 19*b* or in the hole 29*a* & 29*b* of the second plate 25 when it has been retracted and then released. Two retractable button-like tabs 42 & 43 are fixedly attached or welded to intermediate portions on the elongate biased elements 35 & 36 and are disposed substantially perpendicular to the biased elements 35 & 36 and retractably extend through the second holes 20*a* & 20*b* and protrude to the exterior of the side walls 16 & 17. The purpose of the button-like tabs 42 & 43 is to retract the coupling members 40 & 41 from the holes 29*a* & 29*b* of the second plate 25 to quickly and conveniently release and separate the two plates 15 & 25.

To couple the two plates 15 & 25, the user should press on the button-like tabs 42 & 43 with his/her fingers to retract the coupling members 40 & 41 through the first holes 19*a* & 19*b* in the first plate 15 and should then position at least portions of the side walls 16 & 17 of the first plate 15 between the side walls 26 & 27 of the second plate 25 with the first holes 19*a* & 19*b* of the first plate 15 being aligned with the holes 29*a* & 29*b* of the second plate 25 and should then release his/her fingers from the button-like tabs 42 & 43 to release the coupling members 40 & 41 which will slide through the first holes 19*a* & 19*b* of the first plate 15 and the holes 29*a* & 29*b* of the second plate 25 to hingedly couple the two plates 15 & 25 together. The elongate biased elements 35 & 36 urge the coupling members 40 & 41 into the coupling positions. To separate the two plates 15 & 25 for convenient and easy removing of one cooperating object from the other cooperating object such as a lid or cover being removed or separated from the container or appliance, the user presses with his/her fingers on the button-like tabs 42 & 43 to retract the coupling members 40 & 41 from at least the holes 29*a* & 29*b* of the second plate 25 so that the second plate 25 which is fixedly attached to one of the cooperating objects can be removed from the main body which allows the user to repair or replace a damaged lid or cover for instance or to conveniently and substantially clean the main body and the lid or cover which when fastened to the main body makes it extremely burdensome for the user to clean both objects.

Various changes and departures may be made to the invention without departing from the spirit and scope thereof. Accordingly, it is not intended that the invention be limited to that specifically described in the specification or as illustrated in the drawing but only as set forth in the claims.

What is claimed is:

1. A quick release hinged support for hingedly mounting one object to a cooperating object comprising:

a first plate having opposed side walls perpendicular thereto, each of said side walls having a first hole near an edge of said first plate and further having a second hole, said first holes being substantially in alignment to one another, said first plate being attachable to said one object;

a second plate having opposed side walls perpendicular thereto which are adapted to receive at least portions of said side walls of said first plate therebetween, each of said side walls having a hole therethrough near an edge of said second plate, said holes being substantially in alignment to one another, said second plate being attachable to said cooperating object;

a retractable coupling means comprising two elongate biased elements having end portions fixedly attached to said side walls of said first plate; two coupling members fixedly attached to said biased elements and retractably disposed through said first holes in said first plate to hingedly couple said first plate to said second plate; and two button-like tabs fixedly attached to said biased elements and retractably disposed in said second holes in said side walls of said first plate for retracting said coupling members, for quick coupling of said plates and for quickly separating said plates to allow quick coupling and quick separation of said objects.

2. A quick release hinged support as described in claim 1, wherein each of said biased elements has an end portion fixedly attached to a side of said side wall facing said opposed side wall.

3. A quick release hinged support as described in claim 2, wherein said biased elements are leaf springs.

4. A quick release hinged support as described in claim 2, wherein said coupling members are fixedly attached near end portions of said biased elements, said coupling members being disposed substantially perpendicular to said biased elements and being adapted to retractably move in said first holes of said first plate and to releasably and hingedly couple said first plate to said second plate.

5. A quick release hinged support as described in claim 4, wherein said coupling members are adapted to retractably extend in said holes of said second plate to releasably and hingedly couple said second plate to said first plate.

6. A quick release hinged support as described in claim 5, wherein said coupling means are essentially pegs.

7. A quick release hinged support as described in claim 2, wherein said button-like tabs are retractably disposed in said second holes of said first plate and are disposed intermediate on said biased elements to allow a user to press upon said button-like tabs to retract said coupling members.

* * * * *